US005413410A

United States Patent [19]

Mlakar

[11] Patent Number: 5,413,410

[45] Date of Patent: May 9, 1995

[54] TELESCOPING HARDENED AIRCRAFT UNIT LOAD DEVICE

[75] Inventor: Paul F. Mlakar, Vicksburg, Miss.

[73] Assignee: Jaycor, San Diego, Calif.

[21] Appl. No.: 180,376

[22] Filed: Jan. 12, 1994

Related U.S. Application Data

[63] Continuation-in-part of Ser. No. 816,309, Dec. 26, 1991, Pat. No. 5,312,182.

[51] Int. Cl.[6] ..... A47B 96/00

[52] U.S. Cl. ..... 312/409; 312/140; 312/293.3

[58] Field of Search ..... 312/409, 140, 293.3, 312/201, 111, 107, 292, 298, 299, 304, 350, 205; 220/23.6, 1.5, 350

[56] References Cited

U.S. PATENT DOCUMENTS

| | | | |
|---|---|---|---|
| 1,992,640 | 2/1935 | Steen | 312/205 |
| 3,159,436 | 12/1964 | Davis | 312/107 |
| 3,636,661 | 1/1972 | Strawsine | 312/304 |
| 3,705,754 | 12/1972 | Drum et al. | 312/409 |
| 3,970,010 | 7/1976 | Cantley | 312/298 |
| 5,312,182 | 5/1994 | Mlakar et al. | 312/409 |

*Primary Examiner*—Victor N. Sakran
*Attorney, Agent, or Firm*—Nydegger & Associates

[57] ABSTRACT

A hardened telescoping load carrying device includes a plurality of telescoping container sections with interlocking edges and a door with interlocking edges. The telescoping sections are loaded with baggage one at a time and then extended outwardly. The interlocking edges on the telescoping sections interlock when the device is in the fully extended configuration. The interlocking edges on the telescoping sections and on the door engage with increasing force in the event of an explosion within the device.

11 Claims, 6 Drawing Sheets

TELESCOPING HARDENED AIRCRAFT UNIT LOAD DEVICE

This is a continuation-in-part application of U.S. patent application Ser. No. 07/816,309 filed on Dec. 26, 1991 now U.S. Pat. No. 5,312,182.

FIELD OF THE INVENTION

The present invention pertains to load carrying containers. More particularly, the present invention pertains to load carrying containers which will resist the blast effect of an explosive detonation inside the container. The present invention is particularly, but not exclusively, useful as a container for carrying luggage and other cargo during transport by aircraft.

BACKGROUND OF THE INVENTION

It is an unfortunate fact that terrorists often attempt to influence the course of political events through the use of violence. One infamous means for implementing these violent actions is by strategically placing bombs where they will cause the greatest devastation and have the greatest political impact. Indeed, bombs almost seem to be a terrorist weapon of choice. As is well known, terrorist targets are typically chosen on the basis of their vulnerability to such attack and are frequently, if not purposefully, selected without regard for human life. Crowds of people can, therefore, be an attractive terrorist target due to the intense public reaction that mass murder will provoke. Further, vehicles are attractive targets because they are compact and will almost always contain people when they are being operated. Aircraft effectively combine these attractions.

Despite extremely tight security procedures, and the use of sophisticated explosive detecting electronic equipment, it happens that bombs have still found their way aboard aircraft. Typically, it has happened that bombs have been found hidden in passenger luggage or in parcels which are stored and carried in the cargo compartment of an aircraft. There is, of course, a limit to the size of bomb which can be relatively easily detected. Consequently, one strategy is to recognize that small bombs may not always be detected and then plan on ways in which to reduce the damage which can be caused by a small bomb.

Within the airline industry it is a standard practice to compartmentalize the cargo which is to be carried on board the larger aircraft. This is done by separating the cargo into separate units and placing these units of cargo into individual containers which are commonly referred to as unit load devices (ULDs). Because of regulatory requirements, as well as practical considerations, the shape, size and weight of a ULD for each type aircraft has been pretty much standardized. Consequently, in order to design a ULD which will meet the standard requirements of the industry, and still effectively withstand a substantially large blast from an explosion in the cargo held within the ULD, these limitations need to be considered.

Typically, ULDs are shaped as boxes which can include appropriately sloped surfaces that conform the ULD to the aircraft's fuselage when the ULD is placed in the aircraft's cargo compartment. Essentially, the container is made of several panels which are joined together to form the ULD. Additionally, each ULD has a door or an access hatch which allows it to be opened for placing cargo in the ULD or for removing cargo from the ULD.

From studies which have been conducted to determine how a standard ULD will react to an internal explosion, it is known that the panels which form the container of the ULD will tend to bulge outwardly from the blast. Further, it is known that panels are relatively strong in structurally resisting the tensile stresses which are directed in the plane of the panel. Stated differently, panels are relatively effective in resisting rupture. On the other hand, stress analysis shows that the highest stress concentrations which result from an explosion within the ULD occur at the joints and around the door or hatch which covers the opening into the ULD. One obvious means for providing a hardened ULD is to simply add more material at the points where the highest stress concentrations occur. It is preferable, however, to avoid this additional weight. Instead, though some reinforcing material may be selectively used, the present invention recognizes that a proper design for the components of the ULD, and a proper design for the interaction of these components, are effective in helping solve the presently existing problems.

It is known to first containerize the baggage outside the aircraft and then load the containers into the aircraft. The loading of such containers requires special handling equipment. In addition, the container itself can occupy a significant amount of space, and unless it is very carefully loaded, more space can be wasted. Therefore, it can be desirable to use a telescoping container which can be loaded into the aircraft empty and then loaded with baggage and expanded in place. Even with the use of such telescoping containers, it is desirable to protect against the harmful effects of an explosion.

In light of the above it is an object of the present invention to provide a telescoping hardened load carrying device for use in transporting cargo on aircraft which is able to resist internal blasts without rupturing. Another object of the present invention is to provide a telescoping hardened load carrying device which meets the regulatory standards for the use of such devices in air transport operations. Still another object of the present invention is to provide a telescoping hardened load carrying device which allows relatively easy access into the device through an opening which can be effectively covered without compromising the efficacy of the device. Another object of the present invention is to provide a telescoping hardened load carrying device which is easy to use, relatively easy to manufacture, and comparatively cost effective.

SUMMARY OF THE INVENTION

In accordance with the present invention, a telescoping hardened load carrying device for holding luggage and cargo during air transport includes a plurality of telescoping container sections, each of which is formed by a plurality of panels. Preferably, the panels are substantially flat and are formed with additional material at their peripheries. The panels are joined together along their respective peripheries to form a box-like container section of unitary construction which has reinforced joints.

Each container section fits snugly within, or "telescopes" into, an adjacent container section. Similarly, three or more container sections can be telescoped together, as required. Further, the container sections can all telescope in one direction from a first section, or the sections can telescope in two opposite directions from a center section. In the fully extended position, each section is kept attached to its adjacent section, or sections, by a channel formed into the edge of the section. The cross section of the channel can be in the shape of a J. On one section, the J channel is turned outwardly, while on the mating edge of the adjacent section, the J channel is turned inwardly to interlock with the outwardly turned J channel on the edge of the first section. Because of the interlocking relationships between the J channels on the edges of adjacent sections, an explosion within the container causes the tensile stress in the container section panels to result in an increasingly forceful engagement between the container sections, thereby assisting in containing the explosion.

One of the container sections is formed with an opening through which luggage and cargo can be placed into, or removed from, the container, and a slot borders at least part of the opening. The slot itself is formed with a C channel which has a pair of opposed and substantially parallel rims. Each of the rims has a lip which extends over part of the C channel and each lip has a protrusion which projects part way into the C channel. Together, these lips and their associated protrusions establish a pair of opposed crooked thumbs for the slot. As so positioned in the C channel, a slit is created between the thumbs.

A door for covering the opening of the container, and for holding luggage or cargo in the container, includes a rail which is formed along portions of the edge of the door. This rail includes a flange which is attached substantially perpendicular to the edge of the door panel and which projects therefrom in opposed directions. Further, the flange has a pair of extensions, each of which are on opposite sides of the door panel and which are oriented substantially parallel to the door panel. The extensions thus overlap the door panel to establish a pair of opposed crooked fingers.

The C channel bordering the opening of the container is dimensioned to slidably receive the rail of the door. Thus, the door can be engaged with the container to cover the opening and enclose the load in the container. Importantly, due to the interlocking relationship between the crooked thumbs of the C channel and the crooked fingers of the rail, the C channel grips the rail in response to an explosive blast within said container to resist rupturing of the device.

Preferably, the hardened load carrying device is made of a blast resistive material, such as an epoxy or resin reinforced with high tensile strength fibers, such as SPECTRA TM fibers by Allied Signal. Further, the container of the device is preferably of unitary construction and any additional strengthening material which may be needed is used selectively and only at points where relatively high stress concentrations are anticipated.

If desired, the crooked thumbs of the C channel on the container and the crooked fingers of the rail on the door can be replaced with other interlocking structures. Specifically, the protrusions from the lips in the C channel which form the crooked thumbs are eliminated. Thus, the C channel is substantially converted to a T-shaped slot. Further, the flanges at the edge of the door remain, but the extensions from these flanges which formed the crooked fingers are eliminated. With this structure, the flanges are slidingly received in the cooperative T-shaped slot to interlock the door with the container.

Alternatively, a door can be provided wherein the flanges are rounded and the flange along at least one side of the door acts as a rail. Additionally, at least one panel of the device is formed with a cradle to receive and hold the rail. Also, the cradle has a slit for receiving the door panel therethrough. Thus, as the door panel is passed through the slit to cover the opening, the load is enclosed in the compartment of the container, and at least part of the rail is positioned in the cradle for engagement with the cradle to resist rupturing of the device in the event of an explosive blast inside the compartment.

For all embodiments of the present invention, each container section can be further reinforced by constructing the container section of panels which include a plurality of substantially parallel fibers. The fibers are aligned and oriented in the panels to cross perpendicular to the joints which are established at the intersections of the panels.

The novel features of this invention, as well as the invention itself, both as to its structure and its operation will be best understood from the accompanying drawings, taken in conjunction with the accompanying description, in which similar reference characters refer to similar parts, and in which:

DESCRIPTION OF THE PREFERRED EMBODIMENTS

Figure 1:
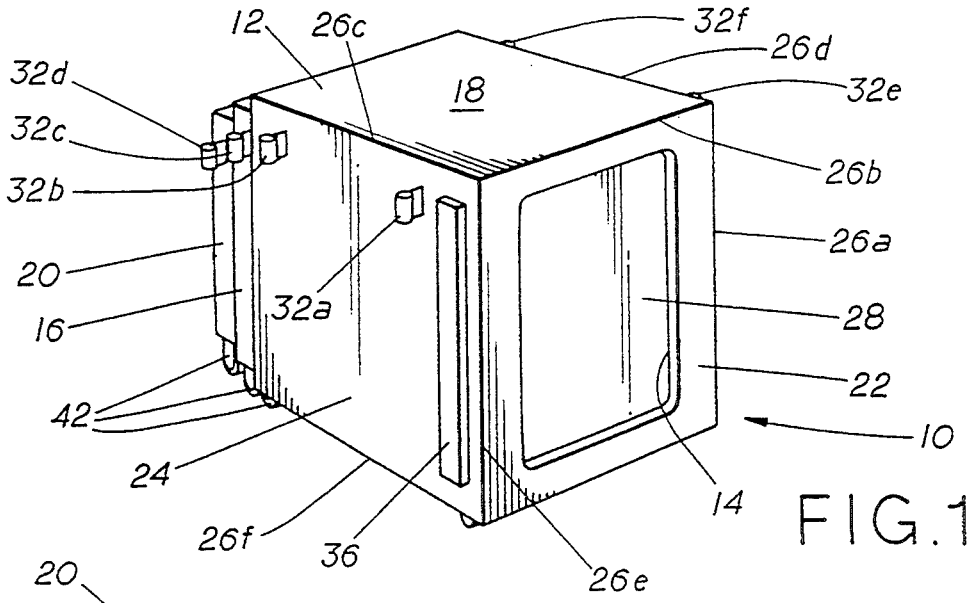
FIG. 1 is a perspective view of the telescoping hardened load carrying device of the present invention in the collapsed condition.

Referring initially to FIG. 1, the telescoping hardened unit load device (HULD) of the present invention is shown and is generally designated 10. As seen in FIG. 1, HULD 10 includes a plurality of container sections 12,16,20, one of which is formed with an opening 14. Container sections 12,16,20 are telescoped inwardly, configuring HULD 10 in the collapsed condition in which it would be loaded into the aircraft prior to loading the baggage. Although the actual size and configuration of the HULD 10 can be varied to meet specified space requirements, the particular configuration shown in FIG. 1 is readily adaptable for use with most aircraft. This particular HULD 10 has three container sections 12,16,20 that are made using a plurality of substantially flat panels. For HULD 10, the top panel 18, side panel 24, and front panel 22, are exemplary. These, and the other panels which are necessary to create container sections 12,16,20, are connected to each other at joints 26*a,b,c* etc. along their respective peripheries where the panels intersect each other. Further, front panel 22 is shown with an opening 14 and a door 28.

Figure 3:
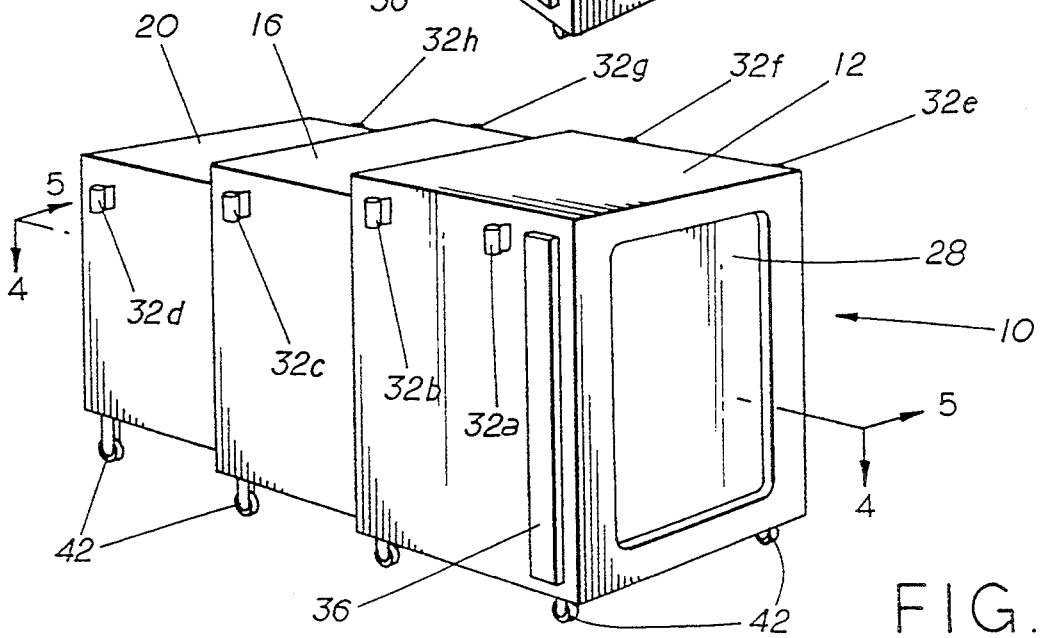
FIG. 3 is a perspective view of the hardened load carrying device shown in FIG. 1, in the fully extended condition.

If appropriate, HULD 10 can have guide rollers 32*a* through 32*h* attached along the sides of container sections 12,16,20, as shown in FIGS. 1 and 3, to guide the movement of the container sections when HULD 10 is expanded during loading, as will be discussed later. It is often necessary to guide container sections 12,16,20 along the aircraft fuselage, or between other containers, during expansion. In addition, support rollers such as roller 42 are provided on the bottom of container section 20 to facilitate expansion of HULD 10 during loading.

Importantly, the material used for the construction of container sections 12,16,20 and the door 28 should exhibit a very high strength to weight ratio and offer high impact strength, thermal stability, chemical resistance and relatively low flammability and off-gas emissions. Such a material is commercially available and is marketed under product names KEVLAR TM by DuPont, or SPECTRA TM. Preferably, the SPECTRA TM material used for HULD 10 is provided as a reinforced epoxy or resin laminated with SPECTRA TM fibers, which can be molded to establish a container section 12,16,20 having a unitary body structure. Tests indicate that many layers, perhaps as many as twelve to twenty five layers, depending on the particular weave of SPECTRA TM fabric may be required to withstand a bomb which cannot be easily detected. These tests also indicate that a HULD 10 capable of withstanding such a blast would have a tare weight at the upper end of the range of standard unhardened ULDs. Container sections 12,16,20 having lower tare weights will, of course, be less tolerant to blasts.

Figure 2:
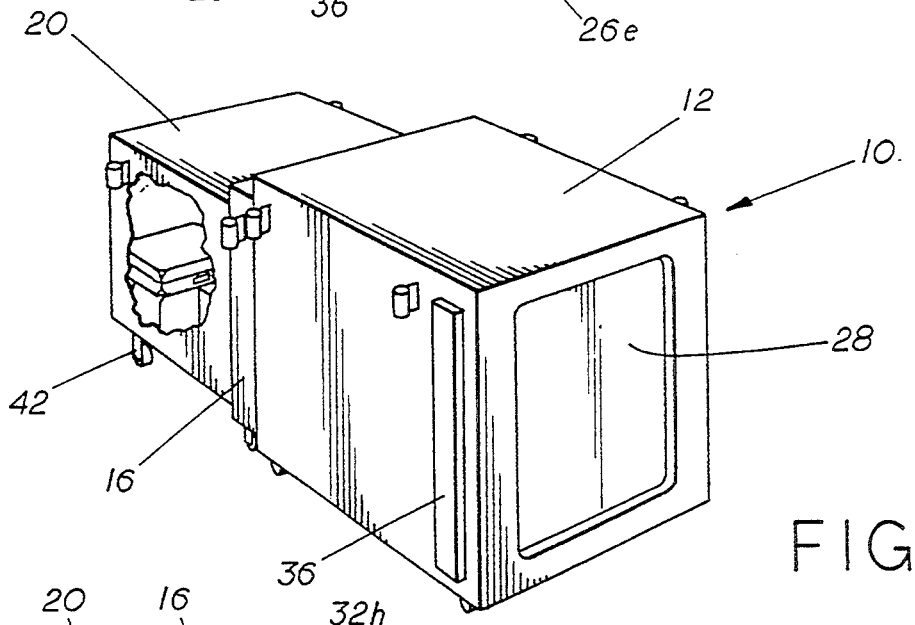
FIG. 2 is a perspective view of the hardened load carrying device shown in FIG. 1 in the partially extended condition.

FIG. 2 shows HULD 10 in the partially expanded configuration, with container section 20 extended or telescoped outwardly from adjacent container section 16. Baggage can be seen through the cutaway section of the side panel, illustrating that container section 20 has been loaded with baggage before being telescoped outwardly. Support roller 42, and other support rollers (not shown), support container section 20 as it is extended from container section 16. In this partially expanded configuration, container section 16 is ready to be loaded with baggage.

FIG. 3 shows HULD 10 in the fully extended or expanded configuration, with container section 20 fully telescoped outwardly from container section 16, and with container section 16 fully telescoped outwardly from container section 12. Support roller 42, and other support rollers (not shown), support container sections 16 and 20 as they are extended. In this extended configuration, container section 12 can be loaded with baggage.

Figure 4:
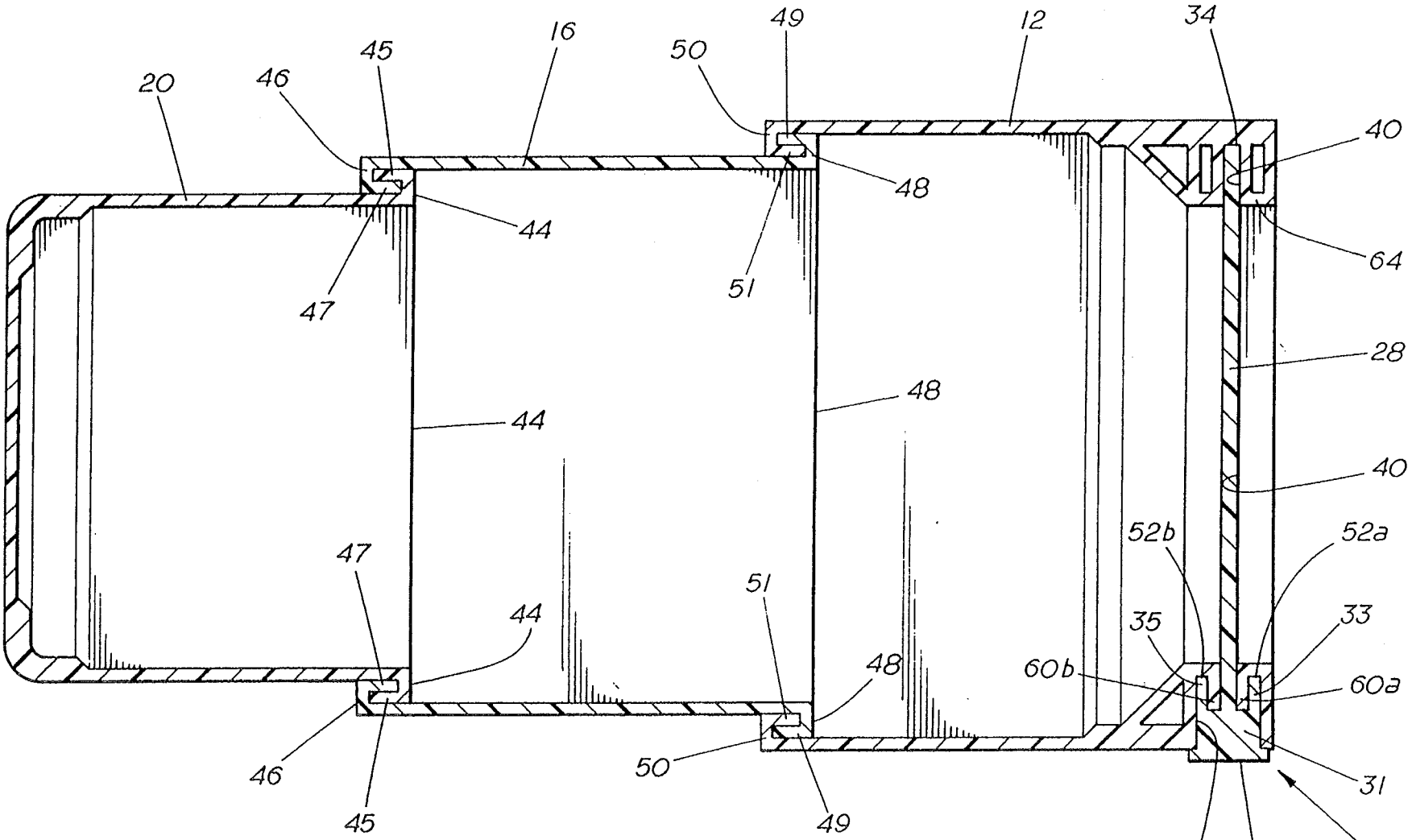
FIG. 4 a cross sectional view of the device as seen along the line 4—4 in FIG. 3.

FIG. 4 is a cross sectional view of HULD 10, taken along line 4—4 in FIG. 3, essentially looking downward through the device. As can be seen, HULD 10 is in the fully expanded condition. Formed along the open front edge of container section 20 is a J shaped channel 44, with its integral lip 45 oriented outwardly from and parallel to the side, top and bottom panels of container section 20. Channel 44 is formed all the way around the open edge of container section 20, with lip 45 oriented outwardly.

Similarly, J shaped channel 46 is formed along the rear edge of container section 16, with its lip 47 oriented inwardly from and parallel to the side, top, and bottom panels of container section 16. Channel 46 extends all the way around this rear open edge of container section 16. As can be seen, lip 45 of channel 44 fits snugly into channel 46, and lip 47 of channel 46 fits snugly into channel 44, when container section 20 is fully extended from container section 16. On the open front edge of container section 16, J shaped channel 48 is formed, with its lip 49 oriented outwardly from and parallel to the sides, top, and bottom panels of container section 16. Finally, J shaped channel 50 is formed along the open rear edge of container section 12, with its lip 51 oriented inwardly from and parallel to the sides, top, and bottom panels of container section 12. Lip 49 of channel 48 fits snugly into channel 50, and lip 51 of channel 50 fits snugly into channel 48, when container section 16 is fully extended from container section 12.

As mentioned before, the material of which the container sections 12,16,20 are constructed is relatively strong in tension. When an explosion occurs within the fully extended HULD 10, the force of the explosion is largely transformed into a tensile stress in the container section panels. This tensile stress in the panels causes J channel 44 to interlock with increased force with J channel 46, thereby more effectively sealing the explosion within HULD 10. Similarly, J channel 48 interlocks with increased force with J channel 50, resulting in an effective seal. Therefore, rather than causing the joints between container sections 12,16,20 to separate, an explosion will actually cause the joints to seal more tightly.

Figure 5:
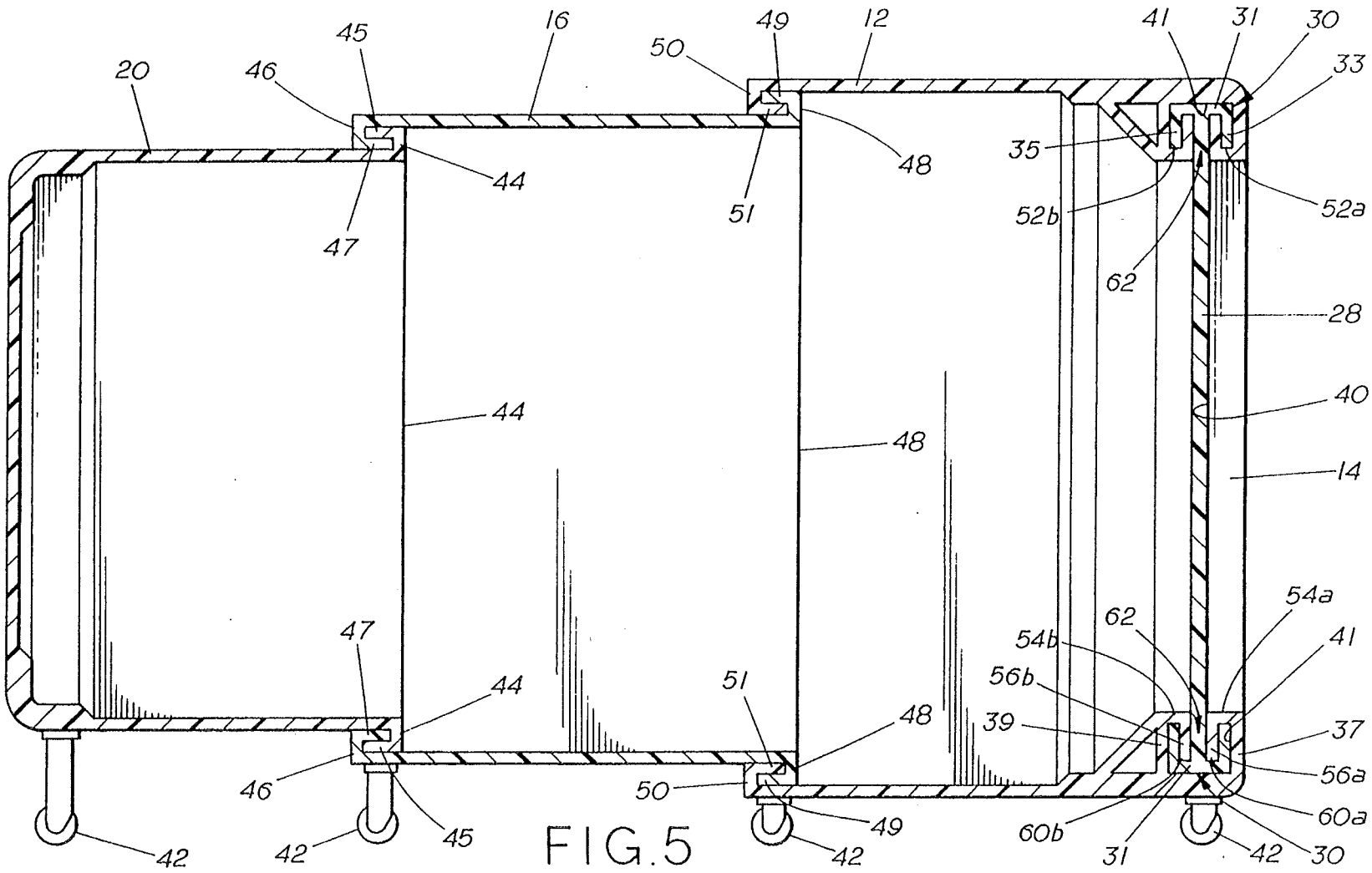
FIG. 5 is a cross sectional view of the device as seen along the line 5—5 in FIG. 3.

FIGS. 4 and 5 also show that the edge of door 28 includes a rail 30 which extends around the edge of the top, bottom, and one side of door 28. The edge of the other side of door 28, however, is not formed with the rail 30. Additionally, as shown in FIGS. 1 through 3, an overlap 36 is formed along the side of rail 30 at one side of door 28. Door 28 slides into a slot in the side of container section 12 to close opening 14. As seen in FIG. 5, the opening 14 is partially bordered by a slot 40 and a C shaped channel 41. Slot 40 extends all the way around opening 14, while C channel 41 extends around the top, bottom, and one side. There is a slot through the side of C channel 41 across the side edge of opening 14 to allow the passage of door 28. The other side edge of opening 14 only has a slot 40.

The door 28 and its interaction with the container section 12, is similar to the joint structure disclosed for the open edges of container sections 12,16,20 of HULD 10 of the present invention. Specifically, the rail 30 includes a flange 31 which is integrally attached to the top, bottom, and one side edge of door 28. The flange 31 is oriented substantially perpendicular to the plane of the door 28 and extends in opposite directions from the edge. Extensions 33 and 35 are integrally attached to the flange 31, as shown, and each extension 33,35 is oriented substantially parallel to the door 28. With this structure, the rail 30 is seen to include a pair of oppositely disposed crooked fingers 52*a* and 52*b*. The crooked fingers 52*a* and 52*b* are shown in FIGS. 4 and 5 as being formed as part of the panel of door 28.

Still referring to FIGS. 4 and 5, it can be seen that the slot 40 which borders opening 14 into the container section 12 is formed to include a C channel 41 along the top, bottom, and one side. The C channel 41 has a pair of opposed rims 37 and 39, and also has a pair of lips 54*a* and 54*b* which respectively extend out and over the C channel 41 from the rims 37 and 39. The protrusions 56*a* and 56*b* project part way into the C channel 41, respectively from the lips 54*a* and 54*b* substantially as shown in FIG. 5, to establish a pair of opposed crooked thumbs 60*a* and 60*b* for the C channel 41. With this structure, a slit 62 is established between the thumbs 60*a* and 60*b*.

Rail 30 on door 28 slidingly engages with the C channel 41 along the top, bottom, and one side of opening 14 into the container section 12. More specifically, the fingers 52*a* and 52*b* of rail 30 interlock with the thumbs 60*a* and 60*b* of C channel 41. Further, in FIG. 4 it will be seen that similar structure causes fingers 52*a* and 52*b* to interlock with thumbs 60*a* and 60*b* at the side of door 28 when the door 28 is fully engaged with the container section 12 to completely cover the opening 14 with the door 28.

Alternatively, rail 30 can be formed without extensions 33,35 on flange 31, and C channel 41 can be formed without protrusions 56*a* and 56*b* on lips 54*a* and 54*b*. This yields a flange 31 slidingly engaged within a T shaped slot in C channel 41 along the top and bottom, and a simple slot along the side, an example of which can be seen in FIG. 6.

Figure 6:
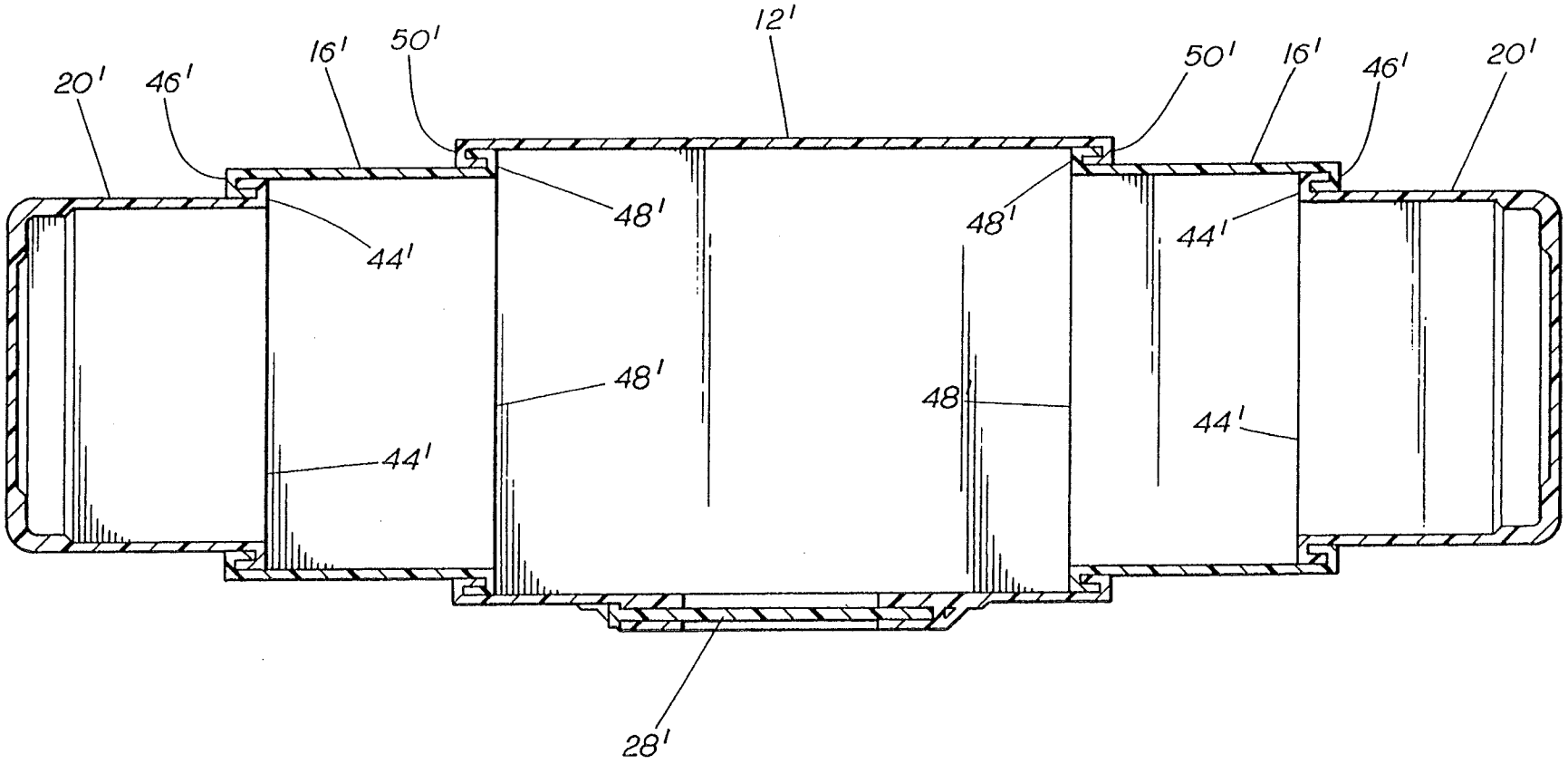
FIG. 6 is a cross sectional view of an alternate embodiment of the hardened load carrying device of the present invention.

As shown in FIGS. 4 and 6, the remaining side 34 of door 28 is not formed with a rail 30. Instead, the edge is left exposed at the side 34 of door 28. Further, the corresponding side 64 of the opening 14 is formed with a straight slot 40, without a channel. Accordingly, as shown in FIGS. 4 and 6, when door 28 is fully engaged with the container section 12 to completely cover opening 14, the side 34 of door 28 is inserted into the slot 40 at the side 64 of the opening. Additionally, when door 28 is fully engaged with the container section 12, the overlap 36 rests against the outer surface of side panel 24.

The joints 26*a,b,c,* etc. which are established at the intersections of the panels that form container sections 12,16,20 are all reinforced by providing additional material in the areas that are adjacent to the bend in the joint. The thickness of the area around the joints is approximately twice the thickness of the remainder of the panels. This is done to satisfy structural stress analysis which indicates that the blast from an explosive which is detonated inside the HULD 10 will cause high stress concentrations around the joints. Additional strength can also be provided around opening 14 by establishing cross braces, substantially as shown in FIGS. 4 and 5.

As is well known to the skilled artisan, proper venting can be incorporated into the design of container sections 12,16,20 to appropriately reduce the effect of the blast. The particular size and location of vents are a matter of design choice and can be varied according to the desires of the manufacturer. Regardless of whether HULD 10 is vented, if it does not rupture from an internal explosion, the aggregate effect of a blast will be minimized both inside and outside HULD 10, and, in most cases, the resultant damage can be effectively controlled.

As envisioned for the HULD 10 of the present invention, in the event an explosive device (not shown) is somehow positioned inside the HULD 10, an explosion of this device will be stifled by the HULD 10. This is so for several reasons. Firstly, the resin or epoxy SPECTRA TM composite material preferably used in the manufacture of the HULD 10, has superior strength characteristics. Additionally, SPECTRA TM is known to be an effective material for resisting puncture or rupture. Secondly, and very importantly, the structural design of the HULD 10 for the interaction between the door 28 and the container section 12, and between the telescoping container sections 12,16,20 causes these structures to cooperatively resist an internal blast.

In order to appreciate the interaction of the door 28 with the container section 12, or the interaction between the telescoping container sections, consider the effect of a blast inside the HULD 10. Such a blast will create pressure against the door 28 and against the container section panels, and tend to force them outwardly. Consequently, the door 28 and the container section panels will bulge, and the edges of the door 28 will be drawn toward each other. Similarly, the edges of the container section panels will be drawn toward each other. When this happens, the rail 30 along the edge of the door 28 will be driven deeper into engagement with the C channel 41. This causes the rail 30 to grip with the C channel 41. The overall result is that the resistive forces are distributed all along the edge of door 28 to reduce the possibility of a blow out of the door 28 or an unacceptable rupture at the interface between the door 28 and opening 14. Similarly, lips 45,47,49,51 will be driven deeper into engagement with J channels 46,44,50,48 respectively, causing the J channels to grip each other more tightly.

As seen in FIG. 6, HULD 10 can be built in an alternative embodiment to extend in two directions from a center container section. When fully extended, each end container section 20' extends from container sections 16', and container sections 16' extend from center container section 12'. This causes J channels 44' to interlock with J channels 46', and it causes J channels 48' to interlock with J channels 50'. Door 28' can be installed in an opening in the side panel of container section 12'.

Figure 7:
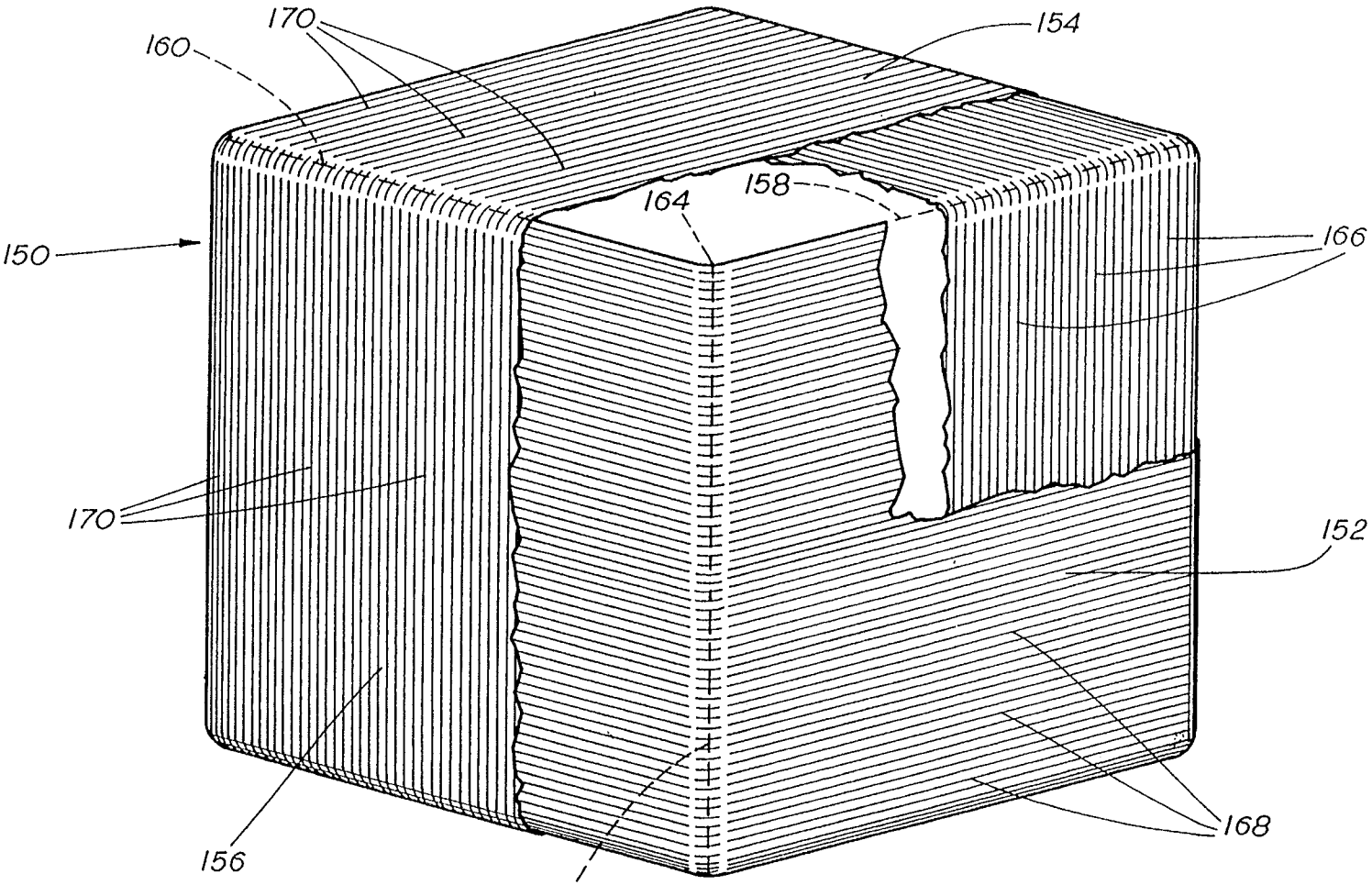
FIG. 7 is a cut away view of the laminar construction of the device shown in FIG. 1.

Additional reinforcement of the hardened unit load carrying device of the present invention is possible by appropriate placement of reinforcing fibers in the panels of the device. As shown in FIG. 7, the box-like structure of a typical unit load carrying device is shown and generally designated 150. Although the specific configuration for the device 150 shown in FIG. 7 is a box, it is to be appreciated that the structure discussed here can be easily modified for adaptation to various configurations of devices. The concept remains the same.

In FIG. 7, the device 150 includes panels 152, 154 and 156. A joint 158 is established between the panels 152 and 154, a joint 160 is established between the panels 154 and 156, and a joint 162 is established between the panels 156 and 152. The intersection of the joints 158, 160 and 162 creates a corner 164.

To reinforce the panels of the device 150, a reinforcing fiber such as SPECTRA TM fiber is used. Typically, materials of this type include continuous fibers which are aligned in parallel to extend uninterrupted throughout the length of the material. Consequently, the added strength imparted to the material by the fibers gives the material superior tensile strength in a direction along the length of the fibers.

As shown in FIG. 7, a first plurality of fibers 166 are aligned in the panel 152 and oriented to extend across the joint 158 for continued alignment in panel 154. Therefore, the first plurality of fibers 166 are oriented substantially perpendicular to the joint 158. Also, a second plurality of fibers 168 are aligned substantially perpendicular to the first plurality of fibers 166 in panel 152 and are oriented to extend across the joint 162 for continued alignment in panel 156. In a manner similar to the alignment of first plurality of fibers 166 relative to the joint 158, the second plurality of fibers 168 are oriented substantially perpendicular to the joint 162. A third plurality of fibers 170 are also provided. This time, the third plurality of fibers 170 are aligned substantially perpendicular to the fibers 168 in panel 156 to extend across joint 160 and into panel 154. Similar to fibers 166 and 168, the fibers 170 are oriented substantially perpendicular to the joint 160 over which they pass. In this manner, the fibers 166, 168 and 170 are interwoven to be positioned across the joints 158, 160 and 162 to give added reinforcement to the device 150 in the event there is an explosion inside the device 150.

Figure 8B:
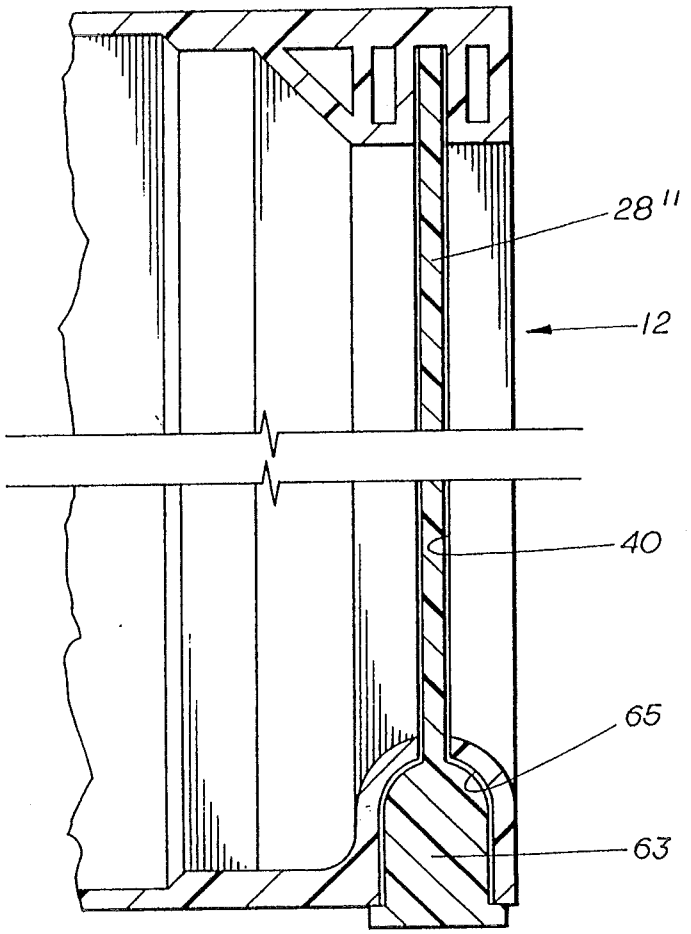
FIG. 8B is a cross sectional view of the alternate embodiment of the door shown in FIG. 8A, as seen along the line 4—4 in FIG. 3.
Figure 8A:
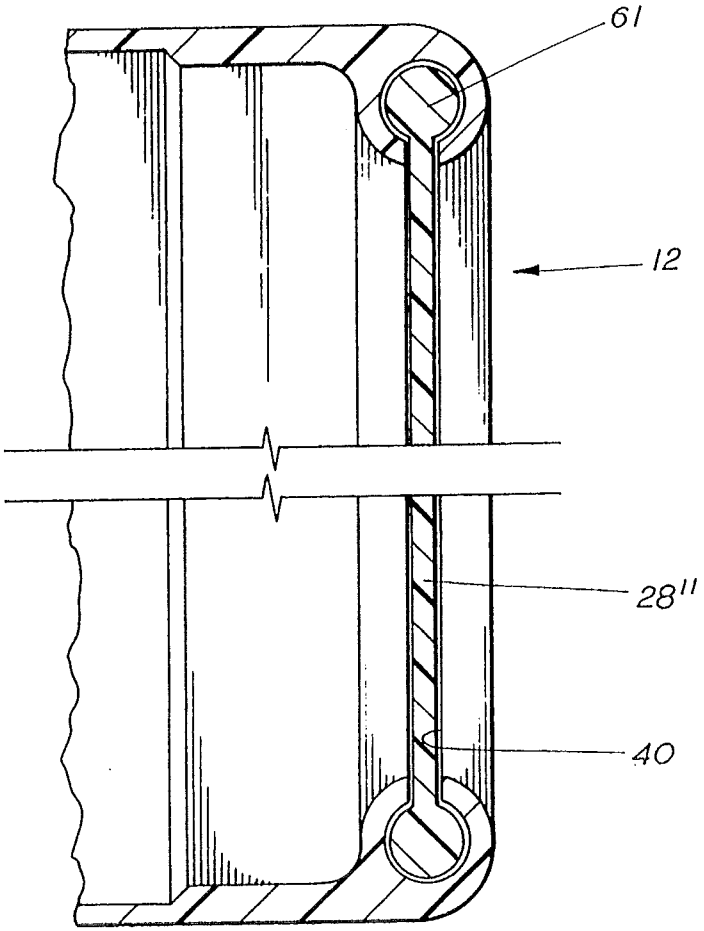
FIG. 8A is a cross sectional view of an alternate embodiment of a door for the present invention, as seen along the line 5—5 in FIG. 3.

Referring now to FIGS. 8A and 8B, another alternate embodiment for the door 28″ is shown. Specifically, for the embodiment of door 28″ shown in FIGS. 8A and 8B, there is a rounded flange 61 which extends along the top, bottom, and one side edge of the door. In FIG. 8A, this rounded edge 61 is shown as a bulb-shaped member in its cross section. The cooperation of structure between the door 28″ of the alternate embodiment and the front panel 22 is perhaps best appreciated by cross referencing FIGS. 8A and 8B. In FIG. 8A it can be seen that the rounded flange 61 on door 28″ slidingly engages with the channel which borders the opening into the container 12. Note, however, that unlike before, the channel is without any crooked thumbs 60. Further, in FIG. 8B it will be seen that similar structure causes a rail 63 at the side of door 28 to rest in a cradle 65 when the door 28″ is fully engaged with the container 12. Thus, the container is closed and the door 28″ in cooperation with the panels of the container, will completely enclose the load.

OPERATION

HULD 10 is first loaded into the aircraft empty, and fully collapsed or telescoped inwardly. Door 28 is then opened and baggage is loaded into container section 20, until container section 20 is full. Then, container section 20 is pushed rearwardly to extend from container section 16. Then, container section 16 is fully loaded with baggage and pushed rearwardly to extend from container section 12. Finally, container section 12 is loaded with baggage, and door 28 is shut. In the embodiment shown in FIG. 6, the same process is followed, first on one side and then on the other.

While the particular telescoping hardened unit load carrying device as herein shown and disclosed in detail is fully capable of obtaining the objects and providing the advantages herein before stated, it is to be understood that it is merely illustrative of the presently preferred embodiments of the invention and that no limitations are intended to the details of the construction or design herein shown other than as defined in the appended claims.

I claim:

1. A telescoping hardened unit load carrying device which comprises:

a plurality of telescoping container sections for holding said load;

a first channel bordering an edge of a first said container section, said first channel having a first outwardly oriented lip; and a second channel bordering an edge of a second said container section, said second channel having a second inwardly oriented lip, said second lip being oriented to engage said first lip on said first channel in an interlocking fashion when said first container section is fully extended from said second container section, to prevent separation of said first and second container sections, and to enclose said load in said device;

wherein said first and second channels interlock with increased sealing force in response to an explosive blast within said device to resist rupturing said device and to seal said blast within said device.

2. A device as recited in claim 1, wherein each said container section is formed with a plurality of panels, each said panel defining a periphery and being joined with other of said panels along their respective peripheries to form said container section with reinforced joints established between said panels.

3. A device as recited in claim 2, wherein each said panel has a first thickness and said joints have a second thickness which is approximately twice said first thickness.

4. A device as recited in claim 3, wherein each said container section is of unitary construction.

5. A device as recited in claim 1, further comprising:

an opening in at least one of said container sections;

a door, having an edge, for covering said opening;

a rail formed on said door along a portion of said edge;

a third channel bordering said opening; and a slit formed in said third channel for slidably receiving said door therethrough to position at least part of said rail in said third channel for increasingly forceful engagement with said third channel in response to an explosive blast within said device, to resist rupturing said device.

6. A telescoping hardened unit load carrying device which comprises:

a plurality of telescoping container sections for holding said load;

a first outwardly oriented channel on a first said container section;

a second inwardly oriented channel on a second said container section, said second channel sealingly engaging said first channel in an interlocking fashion with increased force in response to a blast within said device, when said first container section is fully extended from said second container section;

an opening in at least one of said plurality of container sections;

a door, having an edge, for covering said opening;

a flange attached substantially perpendicular to said edge of said door and projecting therefrom in opposed directions;

a third channel bordering said opening for slidably receiving said flange in an interlocking fashion; and a pair of rims on said third channel, each said rim having a lip extending to create a slit therebetween, said slit being dimensioned to slidably receive said door, said lips interlockingly gripping said flange with increased force in response to an explosive blast within said device, to seal said blast within said device.

7. A telescoping hardened unit load carrying device which comprises:

a plurality of telescoping container sections for holding said load;

a first interlocking means along at least one edge of a first said container section for interlocking with a second interlocking means along an edge of a second said container section adjacent to said first container section;

an opening in at least one of said plurality of container sections;

a door, having an edge, for covering said opening;

a flange attached substantially perpendicular to said edge of said door and projecting therefrom in opposed directions;

a third interlocking means bordering said opening for slidably receiving said flange in an interlocking fashion; and a pair of rims on said third interlocking means, each said rim having a lip extending to create a slit therebetween, said slit being dimensioned to slidably receive said door, said lips interlockingly gripping said flange with increased force in response to an explosive blast within said device; wherein:

said flange has a pair of extensions, each said extension being oriented substantially parallel to said door and overlapping said door to establish a pair of opposed crooked fingers; and each said lip of said third interlocking means has a protrusion projecting alongside said slit to establish a pair of opposed crooked thumbs in said third interlocking means, said thumbs being engageable with said fingers.

8. A telescoping hardened unit load carrying device which comprises:

a plurality of telescoping container sections for holding said load;

a first interlocking means along at least one edge of a first said container section for interlocking with a second interlocking means along an edge of a second said container section adjacent to said first container section;

an opening in at least one of said plurality of container sections;

a door, having an edge, for covering said opening;

a flange attached substantially perpendicular to said edge of said door and projecting therefrom in opposed directions;

a third interlocking means bordering said opening for slidably receiving said flange in an interlocking fashion; and a pair of rims on said third interlocking means, each said rim having a lip extending to create a slit therebetween, said slit being dimensioned to slidably receive said door, said lips interlockingly gripping said flange with increased force in response to an explosive blast within said device;

wherein each said container section comprises a plurality of panels, each said panel defining a periphery and being joined with others of said panels along their respective peripheries to form a container section with reinforced joints established between said panels.

9. A device as recited in claim 8, wherein each said panel has a first thickness and said joints have a second thickness which is approximately twice said first thickness.

10. A device as recited in claim 9, wherein each said container section is of unitary construction.

11. A telescoping hardened unit load carrying device which comprises:

a plurality of telescoping container sections for holding said load;

a first interlocking means along at least one edge of a first said container section for interlocking with a second interlocking means along an edge of a second said container section adjacent to said first container section;

an opening in at least one of said plurality of container sections;

a door, having an edge, for covering said opening;

a flange attached substantially perpendicular to said edge of said door and projecting therefrom in opposed directions;

a third interlocking means bordering said opening for slidably receiving said flange in an interlocking fashion; and a pair of rims on said third interlocking means, each said rim having a lip extending to create a slit therebetween, said slit being dimensioned to slidably receive said door, said lips interlockingly gripping said flange with increased force in response to an explosive blast within said device;

wherein each said container section and said door are made of a fiber reinforced laminate material.

* * * * *